United States Patent [19]

Evensen

[11] 4,424,584

[45] Jan. 3, 1984

[54] ELECTRODE HOLDER ASSEMBLY FOR SELF-BAKING ELECTRODES

[75] Inventor: Knut Evensen, Oslo, Norway

[73] Assignee: Elkem a/s, Olso, Norway

[21] Appl. No.: 309,219

[22] Filed: Oct. 7, 1981

[51] Int. Cl.[3] ..... H05B 7/107

[52] U.S. Cl. ..... 373/97; 373/101

[58] Field of Search ..... 373/97, 96, 89, 101; 204/280, 286, 288, 225

[56] References Cited

U.S. PATENT DOCUMENTS 1,498,582 6/1924 Soderberg ..... 373/89

FOREIGN PATENT DOCUMENTS 462722 12/1951 Italy ..... 373/97

387585 2/1933 United Kingdom ..... 373/97

*Primary Examiner*—Roy N. Envall, Jr.

*Attorney, Agent, or Firm*—Eyre, Mann, Lucas & Just

[57] ABSTRACT

The present invention relates to an electrode holder assembly for self-baking electrodes in an electrothermic smelting furnace. The electrode comprises an electrode casing having vertical fins projecting radially outwards from the casing. A plurality of clamping means are slidably arranged on said fins. The clamping means function both as means for conducting current into the electrode and as means for holding the electrode in position. The clamping means impose only tangentially forces on to the electrode in the baking zone. Protection shields are preferably arranged in lateral direction around the electrode, the shields being arranged between the clamping means or outside. Means for supplying air/gas into the space between the shields and the electrode in order to improve the baking conditions are provided.

15 Claims, 16 Drawing Figures

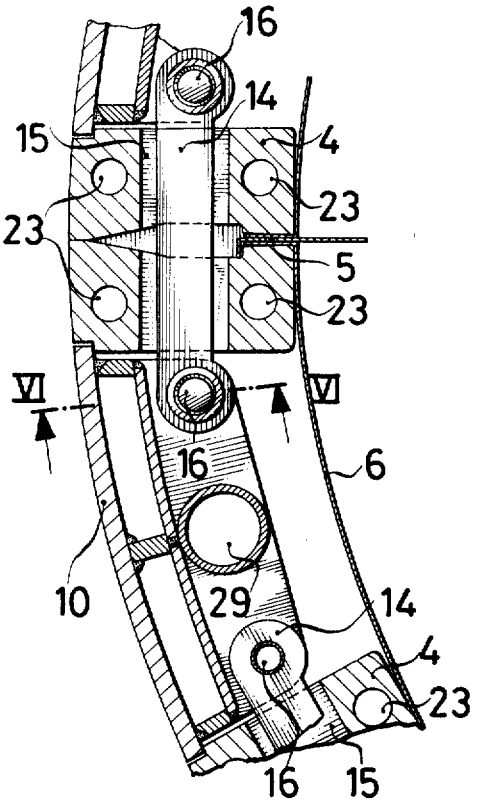
FIG. 5
FIG. 6
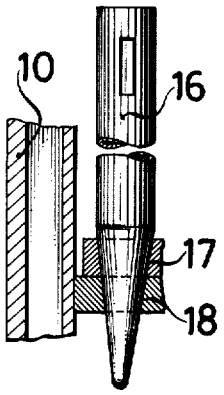
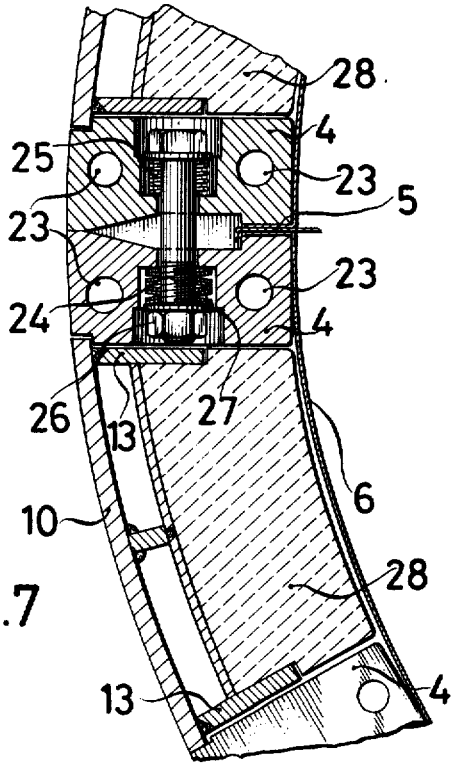
FIG. 7

FIG. 8
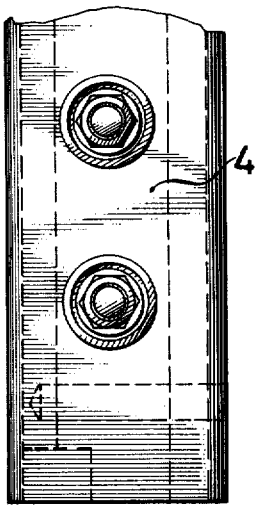
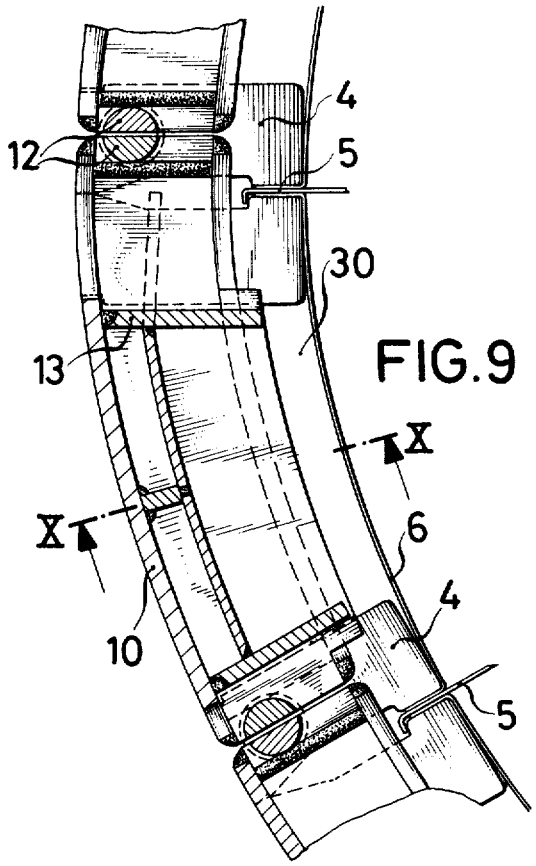
FIG. 9
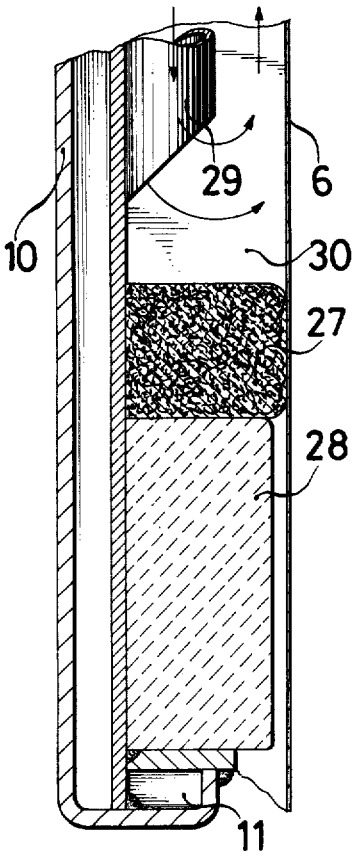
FIG. 10
FIG. 11
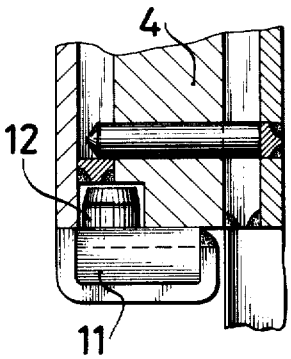

ELECTRODE HOLDER ASSEMBLY FOR SELF-BAKING ELECTRODES

The present invention relates to an electrode holder assembly for electrodes which are used in an electrothermal smelting furnace. In particular, the electrode holder assembly according to the present invention is intended to be used in conjunction with self-baking electrodes such as conventional "Soderberg" electrodes.

The known self-baking electrode typically comprises a metal casing which surrounds both the baked and unbaked portion of the electrode. Internally, the casings of the known electrodes are provided with a plurality of substantially radial and vertically disposed ribs or fins extending inwardly into the electrode paste. Unbaked electrode paste is introduced into the casing at its upper end and this paste is gradually baked by the heat from the furnace as the electrode is fed downwardly through the electrode holder assembly.

It is well-known that the electrode holder assembly must provide excellent electrical contact between the casing of the electrode and the holder assembly. In prior electrode assemblies, outwardly extending ribs of the casing have been used for holding and feeding the electrodes while electric current is conducted to the electrodes through a plurality of contact clamps which exert a radial contact pressure on the electrode. An externally arranged pressure ring serves as the thrust means to enable the contact clamps to exert the required pressure on the electrode.

It has been discovered that a holder assembly of this type imposes relatively large radial forces on the electrode in the critical area where the electrode baking process is occurring. During clamping and feeding of the electrodes, the particles of the unbaked or baking electrode paste exposed to these forces may be subjected to relatively detrimental minute movement between adjacent particles. Such relative movements may cause a defective baking of the electrodes which can ultimately lead to electrode rupture.

For the thermal control of these assemblies, the contact clamps are preferably water cooled and the relatively large cool surfaces of the clamping means adjacent to the casing cause the baking zone to lie in the region near the lower end of the clamping means. It has been discovered that the necessity for cooling the clamping means of these prior assemblies limits both the length of each electrode feeding increment as well as the rate at which the electrode may be fed. Also the relatively large cooled surface of the clamping means may impose thermal shocks on the electrodes in the baking zone whenever there is uncontrolled downtime in the furnace operation so that there is a corresponding increase in the risks of electrode rupture.

The relatively large radial clamping pressure always introduces as well the possibility of the detrimental deformation of the electrode casing which will in turn deform the corresponding section of the electrode itself.

In accordance with the present invention the disadvantages and drawbacks of the previously known electrode holders has been overcome by means of a holder assembly which comprises a plurality of clamping means for slidably engaging ribs extending radially outwardly from the electrode casing. The clamps means function both as contact means for conducting current to the electrode and as clamps for holding the electrode.

In accordance with the invention, the clamping means thus impose substantially only tangential forces on the electrode and the electrode casing for holding and for supplying current thereto.

The clamping means are preferably cooled by means of internally circulating cooling liquid, however, since the cooled surfaces of the clamping means are limited to the reduced area in the lateral direction of both sides of the ribs rather than the casing walls themselves, there is greatly reduced thermal transfer from the electrode.

The clamping means according to the present invention permits the baking of the electrode independently from the geometrical shape of the baked electrode itself and permits as well the use of electrode casings made of other materials other than iron or steel since there is no need to resist radial deformation. It will be appreciated that in many of the processes an electrode assembly which introduces a minimum of iron may be useful and thus the use of casings which may even be made from non-metal is highly advantageous to the reliability and suitability of the electrodes for such processes.

In a preferred embodiment, protection shields, preferably cooled by internally circulating coolant are arranged in zones between each clamping means and the electrode. Further, for best results, these intermediate shields are fastened to the clamping means at the outer edges in order to substantially eliminate any transfer of moments of force imposed by the intermediate shields on the electrode through the clamping means. For best results, the intermediate shields have such a thickness and are disposed in such fashion of the clamping means that the outer surfaces is substantially flush with the corresponding surface of the clamping means, thus together forming a body having a substantially cylindrical outer surface. The shields and clamping means are further rigidly interconnected at the upper end portions by means of plurality of junction plates. For best results, these junction plates are made of an electrically conducting material whereby the upper end portion of the holder assembly acts as a current shunt ring for providing a substantially uniform current distribution in the electrode.

Other embodiments of the invention include an externally arranged cylindrical shield in place of the shield illustrated in FIG. 2. The clamping means are modified so that only the lower ends are in clamping contact with the ribs; the remaining portion of the clamping means are spaced from the electrode to create space for incorporation of a shield of copper between the electrode and clamping means for shortcircuiting the inductive fields created by the current conducted through the clamping means. The inductive heat which would normally be generated by this current can thus be substantially limited.

Further features and advantages of the present invention will be seen from the description of the drawings, wherein:

FIG. 5 shows a horizontal section through a part of the holder assembly, seen along line V-V on FIG. 1;

FIG. 6 shows a vertical section seen along line VI-VI on FIG. 5;

FIG. 7 shows a horizontal section seen along line VII—VII on FIG. 1;

FIG. 8 shows a vertical section through the lower part of the clamps;

FIG. 9 shows a horizontal section seen along line IX—IX on FIG. 1;

FIG. 10 shows a vertical section along line X—X on FIG. 9;

FIG. 11 shows a vertical section through the lower end of the protection shield and the two halves forming each clamp;

Figure 1:
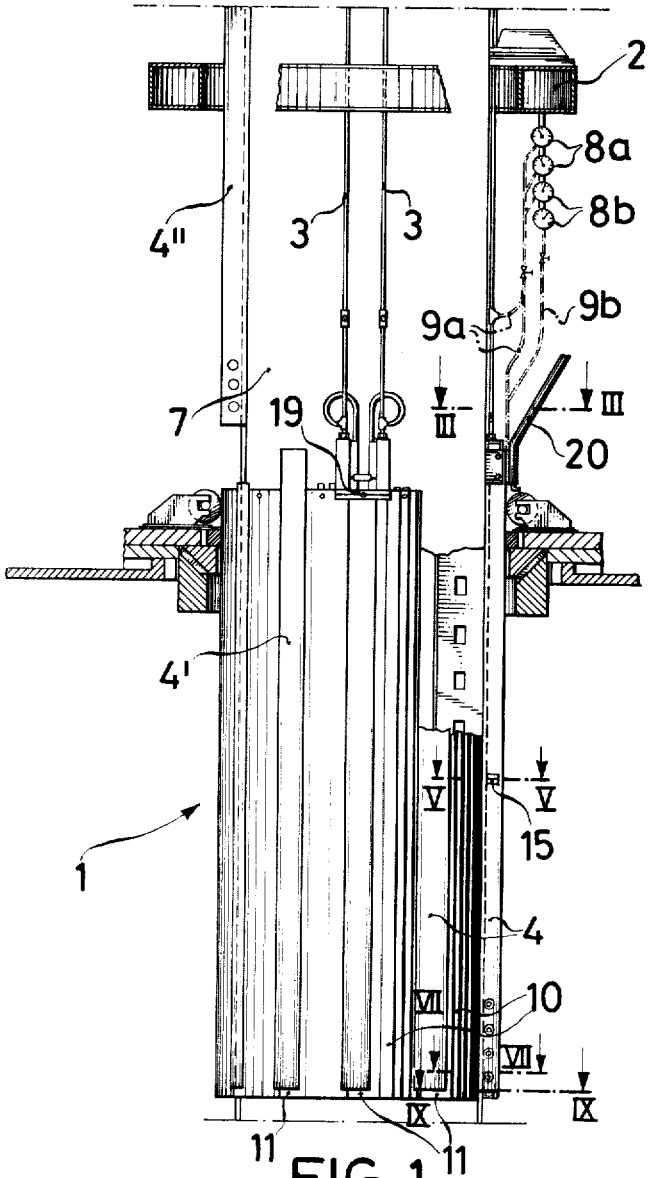
FIG. 1 shows a vertical front elevation of an electrode assembly according to the present invention, the remaining sections of the furnace and suspension means being omitted for clarity.
Figure 3:
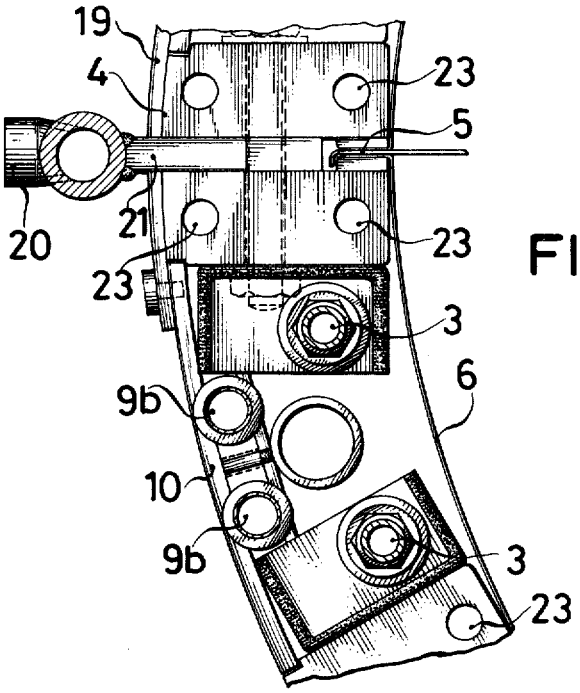
FIG. 3 shows a horizontal section through a part of the holder assembly, seen along line III-III on FIG. 1.

FIG. 1 shows a vertical elevation of an electrode holder assembly 1 which is suspended from a suspension frame 2 by means of struts 3. The holder assembly 1 comprises a plurality of clamps 4 which are slidably arranged on vertical ribs 5, which ribs, as best seen in FIG. 3, project radially outwards from the electrode casing 6. Clamps 4 are evenly disposed about the periphery of the electrode 7.

The clamps 4 preferably comprise seamless elements of electrolytic copper. It will be appreciated by those skilled in the art that with such clamps, the time consuming and complicated shaping, coring, and casting operation which typically have been used to manufacture the conventional contact clamps are eliminated. It will be further appreciated that both the inspection and control routines associated with the manufacturing of the clamps may be reduced to a large extent.

The clamps 4 have cooling conduits therein, forming a cooling system which will be described further below. The internal cooling system is connected to two sets of manifolds 8*a*, 8*b* for the supply and return of cooling liquid respectively, by means of flexible tubes 9*a*, 9*b*. As illustrated the manifolds 8*a*, 8*b* are also supported by the suspension frame 2.

A plurality of intermediate shields 10 are disposed between the clamps 4 and the electrode 7. As best seen in FIG. 5, the shields 10 are supported by the clamps 4 at the extreme edges in order to eliminate the transfer of any moments of force from the shields 10 to the electrodes 7 through clamps 4. The intermediate shields 10 have such thickness and are arranged in such fashion that their outer surfaces are flush with the outer surfaces of the clamps 4 in order to provide a substantially cylindrically shaped body.

It will be appreciated that in accordance with the present invention, the dimensions of the clamps 4 are independent of the electrode diameter and it will be appreciated that the electrode diameter may be varied simply by substituting shields having correspondingly differing radial width. Thus, it will be appreciated that the clamps 4 may be made as a standardized unit which may be utilized for any particular electrode diameter.

It will be further appreciated that each intermediate shield 10 and each set of clamps 4 are preferably separately supported from the suspension frame 2. For best results in terms of access, the radial distance between the frame 2 and the electrode casing must be sufficiently large to permit the clamps 4 and/or shield elements 10, either in single units or together, to be raised from abutment with the electrode. It will be appreciated that any single clamp 4 may be replaced without having to relieve the clamping pressure of the remaining clamps 4. The elements of the clamps 4 may be installed or removed by means of cranes or similar lifting devices (not shown) arranged above the electrode. It will be further appreciated that as an alternative, the shields 10 may be lowered with respect to the clamps 4 to the level where they are free of abutment with the clamps.

In FIG. 1, the reference No. 4' denotes a clamp in a position disengaged from the adjacent shield elements 10 while the reference No. 4" denotes the clamp in a rigid position above the other portions of the electrode holder assembly 1.

Figure 2:
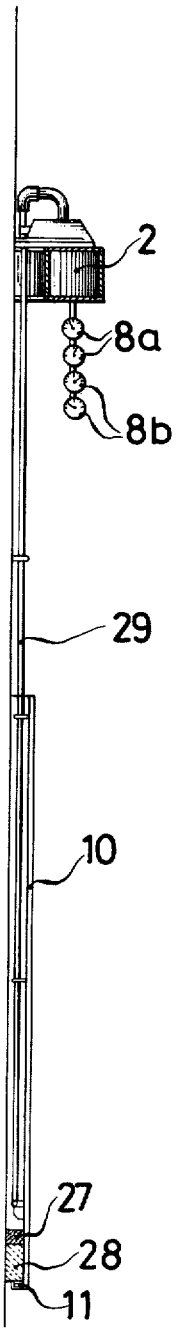
FIG. 2 shows a vertical side elevation of a protection shield.
Figure 4:
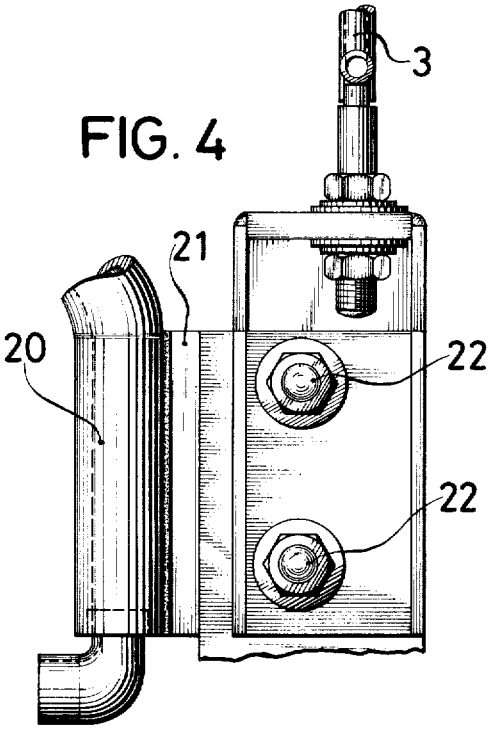
FIG. 4 shows in greater detail a vertical elevation of the suspension means for the holder assembly.
Figure 12:
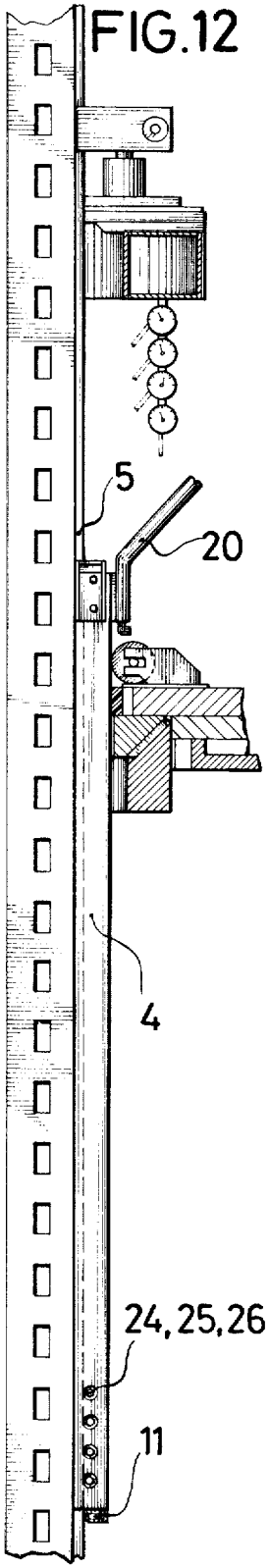
FIG. 12 is an enlarged vertical elevation of the clamp of FIG. 1.
Figure 13:
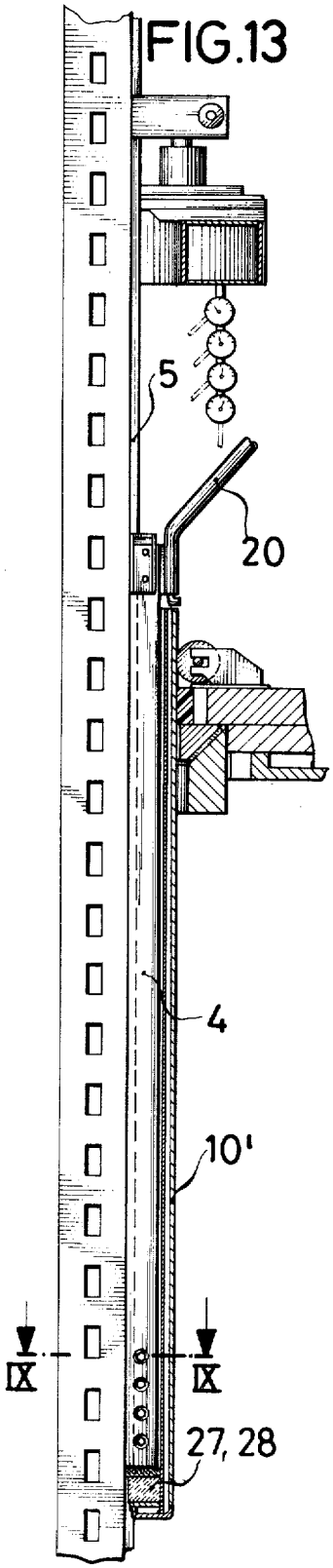
FIG. 13 is a second embodiment of a shield in accordance with the invention.

As seen in FIG. 2 which shows a horizontal section through the upper part of the electrode holder along the line III-III of FIG. 1 and FIG. 4 which shows a vertical elevation of the upper section of the clamps, the clamps 4 are formed of two substantially identical, reversed parts which are disposed on each side of the outwardly projecting ribs 5 of the electrode casing 6. The two reversed halves of the clamps 4 are pressed together by means of a suitably spring-loaded device such as helical or disc springs (which are not shown in FIG. 4).

FIG. 7 shows a horizontal section along the line VII—VII of FIG. 1 and FIG. VIII shows a vertical area of the lower portion of the holder in the vicinity of a clamp'4. A suitable spring device for clamping the two halves of clamp 4 together in order to provide surface clamping pressure and electrical contact is best seen in FIG. 7. Bolt 24 and nut 26 disposed thereon are arranged in a co-axial bore in each of the two halves of the illustrated clamp 4. It will be appreciated that simply by turning the nut 26 on bolt 24, the spring pressure against the shoulders of the bore may be adjusted.

It will be appreciated by one skilled in the art that the portions of the clamps 4 may be held together by means of any suitable hydraulic, pneumatic or mechanical clamping arrangement. However, sufficient clamping force may be provided by means of the spring device to provide the clamping thrust against the ribs 5. It will be appreciated that the thrust thus created acts only in the tangential direction against the ribs and that there is substantially no thrust against the electrode casing in the radial direction. Thus, as shown, the holder assembly 1 is independent of a requirement for a conventional outer pressure ring which is intended to provide the radial thrust for the contact clamp.

Turning again to FIG. 4, electrical current from a source (not shown) is conducted to the clamps 4 through conducting tube 20, the current being introduced at the upper end of the clamps 4. For best results in providing sufficient electrical contact between the tube 20 and two halves of the clamps 4, the tube 20 includes a rib extension member 21 which is disposed between the outer portion of the two halves of clamp 4. When bolts and nuts 22 are tightened, there is provided sufficient contact for the required electrical conduction.

Referring again to FIG. 1 and also to FIG. 7, the shields 10 extend downwardly below the lower ends of the clamps 4. At the lower ends, the shields have both a flange 11, and inward radial extensions 13 at each side which extend towards the electrode 7. These extensions form a shelf for covering the opening between the shields 10 and the electrode casing 6. The shelf and side walls 13 serve as support for refractive lining 28 and a sealing material 27. For best results the refractory brick forming the lining 28 are wedge-shaped in order to prevent a detrimental slipping towards the electrode casing 6.

The lower ends of shields 10 are interlocked along the entire periphery of the electrode 7 by means of bolt or taps 12. Preferably, the bolts 12 are split bolts, one half of which extends up into one of the halves of the clamping means 4 to form a pivot or hinge as best seen in FIG. 9. As shown in FIGS. 1 and 9, the left half of the clamp 4 serves as a hinge for a shield 10. It will be appreciated that shields 10 are thus interconnected around the lower circumference of electrode 7 without interfering with or reducing the clamping force produced by the clamps against the ribs 5.

The interconnecting of the shields in the lower end provides a downwardly and outwardly closed chamber 30 about the electrode 7 itself protecting if from fumes and heat of the furnace. The temperature within the space 30 may be regulated by supplying and/or circulating air or gas through the tube 29.

Referring again to FIG. 5 and to FIG. 6 as well, the shields are further interconnected by means of link members 14 along the entire mid-section of the holder assembly. The links 14 are arranged tangentially through recesses 15 in the clamps 4. Each link 14 is free to move within its recess 15. For best results, the links 14 are fixed to the extensions on shield 10 by means of rods 16 which extend upward from each end of each link 14 above the upper end of the electrode holder assembly so that the rods 16 are manipulatable at this level. As shown, the rods 16 have a conical shaped lower end which fits into a corresponding conical bore 17 through the link 14 and into a conical bore 18 in the extension of shield 10. The link 14 extends through the clamp 4 so that the clamp 4 is unaffected by the link member 14. However, it will be appreciated that the shield members 10 do abut at the outer edges against clamps 4. Thus the interconnection will not transfer any moments of force to the electrode through the clamps. Referring to FIG. 1 and FIG. 3, the clamps 4 and shield 10 are further tied together at the upper end of clamps 4 by means such as junction plate 19, preferably made of copper in order to provide excellent electrical conductivity. It will be appreciated that since as the shields 10 and clamps 4 are interconnected by electrically conductive means, the upper portion of the holder assembly surface will act as a shunt ring for distributing electrical current around the entire periphery of the electrode 7.

As previously mentioned, each shield 10 and each clamp 4 is preferably separately supported from a suspension arrangement. The suspension arrangement incorporates means for feeding of the electrode (not shown in the drawings). Sufficient space is provided by the suspension arrangement and electrode casing to enable the shields and/or the clamps to be lifted up through the spacing by means of electrode hoisting equipment or other hoisting apparatus (also not shown).

Referring again to FIG. 5, where the two halves of clamps 4 are shown, it will be noted that each half is provided with conduits or bores 23 therein for the circulation of coolant. It will be appreciated that in accordance with the present invention, the cooled surface portion of each current-carrying clamp 4 is only in contact with a rib 5 and the cooled area of the electrode corresponds only to the lateral dimensions of the clamp 4. The heat transfer from the casing is thus held to a minimum so that a major portion of the heat energy will tend to remain in the electrode paste in the baking zone of the electrode and will not be transferred to the coolant.

Alternative embodiments of an electrode holder in accordance with the invention are illustrated in FIGS. 12 through 16. Since the embodiments in these figures correspond substantially to the embodiment already described only the differences will be discussed below. The numerals designating the parts in these figures which are unchanged from the previous embodiment will be identical to those previously used.

Figure 15:
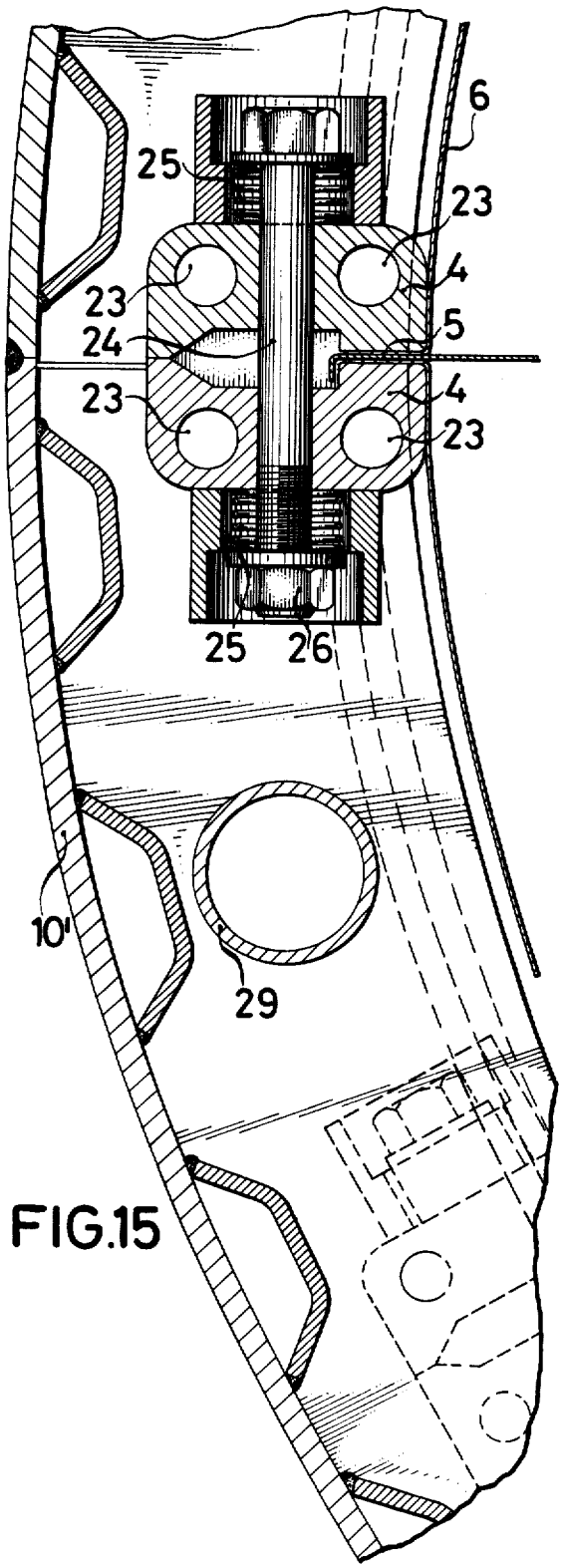
FIG. 15 is a horizontal section through the embodiment of FIG. 13 or 14 taken along the line XIV—XIV of FIG. 13.
Figure 16:
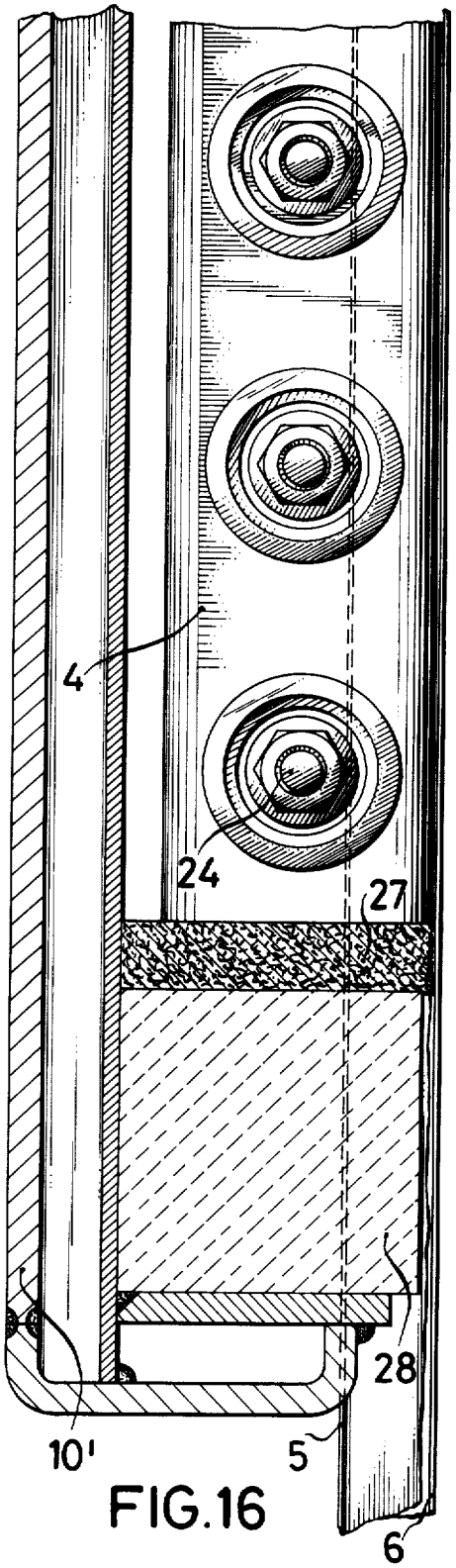
FIG. 16 which is a vertical elevation of the lower end of the clamping means and shield of FIG. 13 or 14.

As best seen in FIGS. 15 and 16, the electrode holder of these embodiments comprises clamps 4 (or 4*a*) arranged within an externally disposed cylindrical shield 10'. Thus it is immediately apparent that the intermediate shields 10 of the previous embodiment which were disposed between the clamping means may be replaced by annular cylindrical screen 10' which may be supported in any conventional manner for totally enclosing the outer surface of the electrode holder. It will be appreciated that for interchangeability, preferably the outer radius of the shield 10' should correspond to the outer radius of the combination of intermediate shields 10 and the clamping means shown in FIG. 1. For best results then, the radial dimension of clamping means 4 are reduced over that illustrated in FIG. 5 so that the external shield 10' may be easily accommodated.

Figure 14:
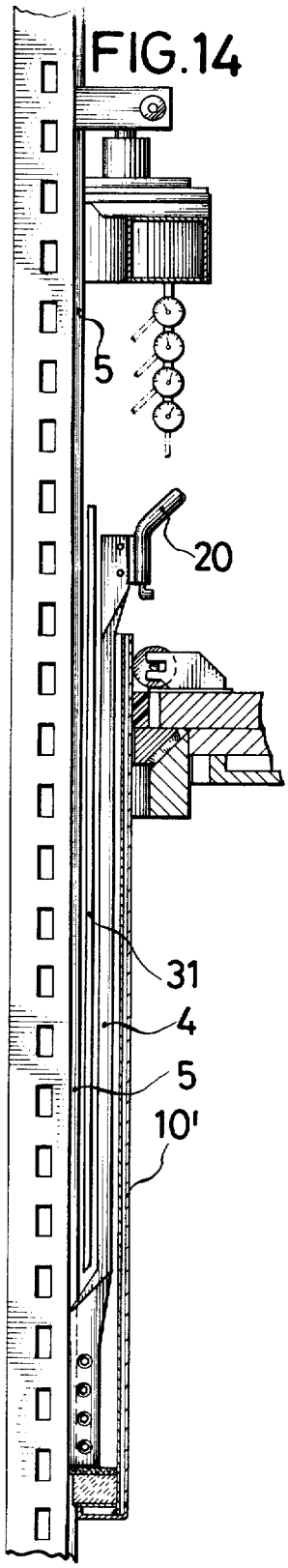
FIG. 14 is a vertical elevation of a third embodiment of the invention.

In the embodiment illustrated in FIG. 14 which is a further modification, only the lower end of the clamp means 4*a* is in clamping contact with the ribs 5. The remaining portion of the clamping means 4*a* is fixed in spaced relation with respect to the casing 6 and the ribs 5. This spaced relationship is advantageous since a second shield 31, preferably made of copper, may be disposed between the casing 6 of the electrode and the remaining part of the clamping means 4*a* which is spaced away from the casing. The great advantage of this modification is that it has been discovered that the copper shield 31 will substantially short-circuit the inductive fields created by the electrical current flowing through the clamping means 4*a* to substantially limit the extraneous heat generated by the inductive currents. The copper shield 31 may be supported by separate support means or by insulated supports on the clamping means in any convenient manner (not shown).

For best results in compensating for the increased radial dimension of the external shielding which would normally be necessary due to the positioning of copper shield 31, the portion of the clamping means 4*a* in the vicinity of shield 31 may be twisted so that this portion is at substantially 90° with respect to the lower clamping portion. The advantage of this is best seen from the cross-section of the clamping means shown in FIG. 15. It will be appreciated that the breadth of the clamping means 4*a* as shown by dimension "b" is less than the depth of the clamping means as illustrated by the dimension "d". Therefore, when the clamp is twisted as shown in FIG. 15 there is made available a greater space for the incorporation of the shield 31 within the confines of the radial dimensions of the previous embodiments.

The parts of the holder assembly which are exposed to heat radiation from the furnace are preferably made of electrolytic copper. Because of the excellent heat conduction of the copper, the surface temperature of the clamping element will only differ slightly from the temperature of the circulating coolant therefore it will be appreciated that any thermal stresses due to a temperature gradient may be neglected. Consequently, the cooling effect caused by the coolant in the clamps during any short downtime of the furnace will be a minimum when compared with the cooling effect in the conventional clamping means. It will be appreciated to a person skilled in the art that as a result of the reducing cooling effect the possibility for thermal shock in the electrode is reduced.

It will be further appreciated that in accordance with the invention, the temperature of the coolant may be allowed to increase substantially, since any upper temperature limit is only dependent on the heat resistance of the means for clamping such as the spring device 25. Thus there is an improved possibility for controlling and adjusting the properties of the electrode baking zone so as to enable an increased rate of slipping of the electrode.

A particular advantage of the present invention is that for a given electrode diameter, the external diameter of the electrode holder assembly may be substantially reduced when compared with conventional electrode holder assemblies. As an example, and not as a limitation, for an electrode holder assembly having electrodes with a diameter of 1200 mm, the areas exposed to the furnace gases will be reduced by 20%. The consequent advantage of such reduction is a corresponding reduction in required flow of coolant into the holder assembly by 20%.

It will be understood that the claims are intended to cover all changes and modifications of the embodiment herein shown for the purpose of illustration which do not depart from the scope and spirit of the invention.

What is claimed is:

1. An electrode holder assembly for holding an electrode in an electrothermal smelting furnace, said electrode including a casing having ribs projecting radially outwards from the casing, comprising:

(a) a plurality of clamping means, each said clamping means comprising two substantially identical reversed parts being operative to contact said ribs for conducting current into the electrode; and (b) said clamping means being adapted for slidably clamping only against the ribs of said electrode casing whereby the clamping means impose only tangential forces on the casing of the electrode.

2. The electrode holder assembly of claim 1 wherein each said clamping means includes a cooling circuit.

3. The electrode holder assembly of claim 1 further comprising a plurality of heat protection shields, said shields being arranged respectively on the periphery of the electrode between each pair of said clamping means.

4. The electrode holder assembly of claim 3 further comprising sealing means in the lower end for sealing furnace gases from contact with the upper portion of the electrode.

5. The electrode holder assembly of claim 4 further comprising means for supplying fluid into the space defined by the electrode casing, the lower sealing means, and the interior of the shields.

6. The electrode holder assembly of claim 1 wherein said shields are in abutting contact with said clamping means only along the outer lateral edges of the clamping means whereby transfer of moments of force from the shields to the electrodes through the clamping means is substantially prohibited.

7. The electrode holder assembly of claim 6 wherein the outer surface of the shields are flush with the surface of said clamping means so that in combination with the clamping means a substantially cylindrical body surrounding the electrode casing is obtained.

8. The electrode holder assembly of claim 1 wherein said clamping means are formed of elements of seamless electrolytic copper or cu-alloys.

9. The electrode holder assembly of claim 1 wherein the clamping means further comprise a spring-loaded device for clamping said reversed parts.

10. The electrode holder assembly of claim 9 wherein said clamping means is cooled by an internally circulated coolant.

11. The electrode holder assembly of claim 1 further comprising an annular cylindrical shield disposed external to said plurality of clamping means.

12. The electrode holder assembly of claim 1 wherein said clamping means includes a portion radially spaced from said casing and said ribs and further comprising a second shield disposed between said portion and said casing.

13. In combination an electrode holder assembly and an electrode casing for an electrode of an electrothermal smelting furnace comprising:

(a) an electrode casing having at least one electrically conductive longitudinal rib projecting outwardly therefrom;

(b) at least one clamping means, said clamping means including clamping portions for clamping said at least one rib therebetween for slidably suspending said electrode; and (c) said clamping means being in electrical contact with said rib and being operative to conduct electrical current to said electrode.

14. An electrode holder assembly for holding an electrode in an electrothermal smelting furnace, said electrode including a casing having ribs projecting radially outwardly thereform, comprising:

(a) at least one clamping means, said clamping means being operative to contact one of said ribs for conducting electrical current into the electrode;

(b) said clamping means having a first portion being adapted for clamping only against one rib of said electrode casing for the suspension thereof whereby the clamping means impose only tangential forces on the casing of the electrode;

(c) a second portion of said clamping means being radially spaced from said casing; and (d) a shield being disposed about said casing between said casing and said second portion of said clamping means for short circuiting inductive currents for limiting inductive heating by electrical current in said clamping means.

15. The electrode holder assembly of claim 14 further comprising an annular cylindrical shield externally disposed about said casing and said at least one clamping means.

* * * * *